United States Patent [19]

Karas

[11] 4,192,503

[45] Mar. 11, 1980

[54] TENNIS SERVING CAGE

[76] Inventor: Anthony J. Karas, 634 Beverly Dr., Macomb, Ill. 61455

[21] Appl. No.: 938,301

[22] Filed: Aug. 22, 1978

[51] Int. Cl.[2] ..... A63B 69/40

[52] U.S. Cl. ..... 273/29 A

[58] Field of Search ..... 273/29 A, 127 B, 26 A, 273/55 R

[56] References Cited

U.S. PATENT DOCUMENTS

| | | | |
|---|---|---|---|
| 2,823,034 | 2/1958 | Bingham, Jr. | 273/26 A |
| 3,222,067 | 12/1965 | Letinhiler et al. | 273/29 A |
| 3,810,618 | 5/1974 | Nedwick | 273/55 |
| 3,858,880 | 1/1975 | Graves | 273/29 A |
| 3,951,406 | 4/1976 | Rock | 273/29 R |
| 3,966,205 | 6/1976 | Schain | 273/29 A |
| 3,982,758 | 9/1976 | Howe, Jr. | 273/29 R |
| 3,989,246 | 11/1976 | Brown | 273/29 A |
| 4,030,733 | 6/1977 | Merrihew et al. | 273/29 BB |
| 4,082,27 1 | 4/1978 | Martin | 273/29 A |
| 4,127,267 | 11/1978 | Bay | 273/29 A |

*Primary Examiner*—Richard C. Pinkham
*Assistant Examiner*—T. Brown
*Attorney, Agent, or Firm*—Clarence A. O'Brien; Harvey B. Jacobson

[57] ABSTRACT

A serving cage placeable on a service court area of a standard U.S. Lawn Tennis Association tennis court for capturing tennis balls served into the service court. The serving cage has a collapsible barrier forming a rectangular configuration in plan when in an uncollapsed, operative mode, but is capable of being collapsed into a generally planar mode for storage and transport. The barrier includes a plurality of fence sections each of planar, rectangular configuration and pivotally connected to a pair of adjacent ones of the sections, with the barrier being formed in two halves each of which halves is substantially the same size as the other of the halves in plan, but one of the halves being substantially twice the height from the service court surface than the other of the halves of the barrier.

10 Claims, 5 Drawing Figures

TENNIS SERVING CAGE

BACKGROUND OF THE INVENTION

1. Field of the Invention

This invention relates generally to appliances for practicing the game of tennis, and particularly to a cage placeable on and bordering the service court area of a tennis court for capturing balls hit into the service court during practice of service, and the like.

2. Description of the Prior Art

One of the biggest problems in teaching or practicing the serve in tennis is a place to hit practice balls that will eliminate chasing the balls over other courts. Not only is the tendency of the balls to bounce away from the area of the court being used for such practice and into other courts where players can be disturbed, but much time is lost in retrieving balls for reuse by the person or persons practicing.

U.S. Pat. No. 3,989,246, issued Nov. 2, 1976, to A. I. Brown, et al, discloses a tennis practice system which consists of an enclosure providing a playing area and having a regulation-height net member at one end located in front of a cage-like structure forming the end of the apparatus. Balls are projected toward a person within the enclosure so as to permit the person to practice the return of balls propelled toward the person. As can be appreciated, however, this system does not readily permit a player to practice service.

U.S. Pat. No. 3,858,880, issued Jan. 7, 1975, to C. D. Graves, discloses a tennis practice strike court arrangement wherein several stroke court are arranged around a common receiving court, such that the latter is entirely surrounded by nets. While this arrangement can solve the basic problem by having the ring of nets contain balls hit thereinto, the system disclosed in patent No. 3,858,880 requires a special system to be constructed, thus taking away space that could otherwise be used for the layout of regular tennis courts capable of use in playing a game of tennis.

U.S. Pat. No. 2,823,034, issued Feb. 11, 1958, to H. Bingham, Jr., discloses a recreation enclosure intended generally for the practicing of games employing a ball; but, this enclosure is generally too small for the practice of tennis service. Further, U.S. Pat. Nos. 3,982,758, issued Sept. 28, 1976, to C. L. Howes, Jr., and 4,030,733, issued June 21, 1977, to L. D. Merrihew, et al, disclose tennis court constructions which permit portability and simple erection of the net and enclosing fence portions of a tennis playing area, while U.S. Pat. No. 3,951,406, issued Apr. 20, 1976, to J. H. Rock, discloses a portable platform tennis court construction which again is readily transportable from one location to another.

SUMMARY OF THE INVENTION

It is an object of the present invention to provide an appliance for facilitating the practice of the serve in tennis by eliminating the necessity to chase balls over other courts and possibly disturbing players on such other courts.

It is another object of the present invention to provide a tennis practice device which defines a controlled area where balls hit as during the practice of one's serve can be contained for simple and convenient recovery.

Yet another object of the present invention is to provide a collapsible and readily portable device that can be unfolded to the dimensions of a service court of a regulation tennis court so as to allow the device to fit around the service court and further facilitate the practice of one's serve.

Still another object of the present invention is to provide a tennis serve practice device which can be used indoors or outdoors, on regulation courts, gymnasium floors, or on any level surface, yet is entirely collapsible so that the unit can be easily moved from a practice area and stored in a compact manner.

These and other objects are achieved according to the present invention by providing a tennis serving cage placeable on a service court of a tennis court, or other suitable area, for capturing tennis balls served into the service court, the cage having a collapsible barrier forming a rectangular configuration in plan when in an uncollapsed, operative mode. Preferably, the barrier includes a plurality of fence sections each of planar, rectangular configuration and pivotally connected to a pair of adjacent ones of the other sections, with the barrier being formed in two halves each substantially the same size in plan as the other of the halves of the barrier and including an equal number of the aforementioned sections. But, one of the halves is advantageously substantially twice the height from the service court or other level surface than the other of the halves, with such higher one of the halves being disposed furtherest from the plane of the net forming the front edge of the service court area being used.

Casters advantageously are mounted on the sections of the barrier and disposed for engaging the surface supporting the barrier for facilitating movement of the barrier relative to the support surface so as to position the barrier as desired for use and storage.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
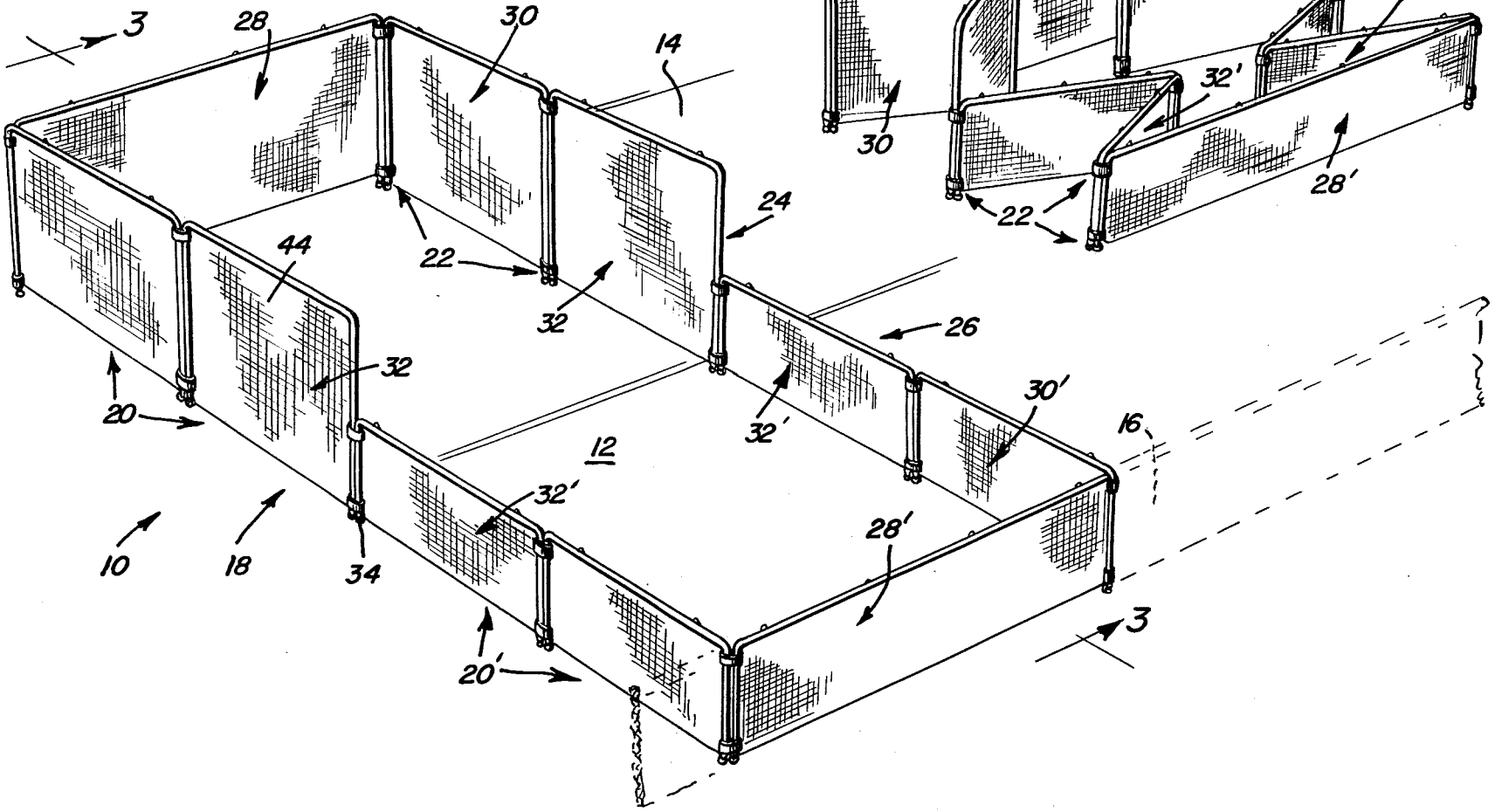
FIG. 1 is a schematic, perspective view showing a serving cage according to the present invention in position around the periphery of the service court of a regulation tennis court, with the cage abutting the net of the tennis court along one side thereof.

Referring now more particularly of the drawings, a serving cage 10 according to the present invention is illustrated in FIG. 1 as placed, in uncollapsed, operative mode, on a service court area 12 of a conventional tennis court 14, and the like. It is to be understood, however, that serving cage 10 can be disposed on any level surface suitable for practicing the tennis serve. When disposed on a tennis court 14, one end wall of cage 10 will be arranged in abutting relationship with a net 16 of the court. Serving cage 10 comprises a collapsible barrier 18 having a rectangular configuration in plan when in an uncollapsed, operative mode, as seen in FIG. 1, and dimensioned so as to conform to the standard dimensions of a service court of a standard tennis court. Barrier 18 includes a plurality of fence sections 20, 20′ each of planar, rectangular configuration in elevation, and pivotally connected to a pair of adjacent ones of the sections 20, 20′ as by the illustrated controlled motion hinge coupler joints 22. Although joints 22 are disclosed as the best mode contemplated for articulating sections 20, 20′ to one another, it is to be understood that any suitable coupler joints can be employed for this purpose.

Figure 2:
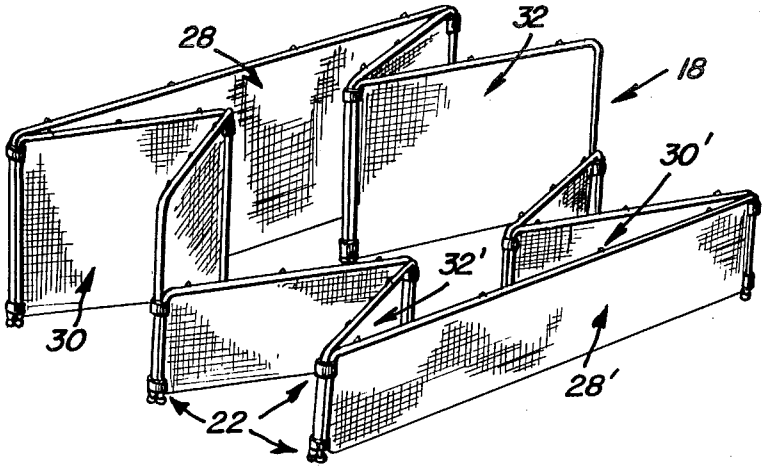
FIG. 2 is a schematic, perspective view showing the serving cage of FIG. 1 in a partially collapsed mode.

Barrier 18 is formed in two halves 24 and 26, each of which halves 24, 26 is substantially the same size in plan as the other of the halves 26, 24, and wherein each of the halves 24, 26 includes an equal number of sections 20, 20′. One of the halves, namely half 24, however, is substantially twice the height from the surface, such as tennis court 14, supporting cage 10 than the sections 20′, 20′ of the other of the halves 26. Each of the halves 24, 26 of barrier 18 include five articulated sections 20, 20′, respectively, forming, in each instance, one end wall 28, 28′ and four paired side walls 30, 30′ and 32, 32′, with each of the side walls being substantially one-half the length of the associated end wall 28, 28′. More specifically, the side walls 30, 30′ and 32, 32′ will be slightly less than one-half the horizontal extent of the end walls 28, 28′ so as to assure proper folding of cage 10 into a compact, substantially unit, in the manner of bending the sections relative to one another as seen in FIG. 2.

A plurality of conventional casters 34 are mounted on the lower end portions of the various sections 20, 20′ of barrier 18, with these casters 34 being disposed engaging the surface of the tennis court 14, and the like, so as to support barrier 18 in such a manner as to facilitate movement of cage 10 relative to the surface supporting same and permit easy movement of cage 10 to and from a practice area where cage 10 is used, and a storage area where cage 10 can be stored in a compact, folded manner.

Figure 3:
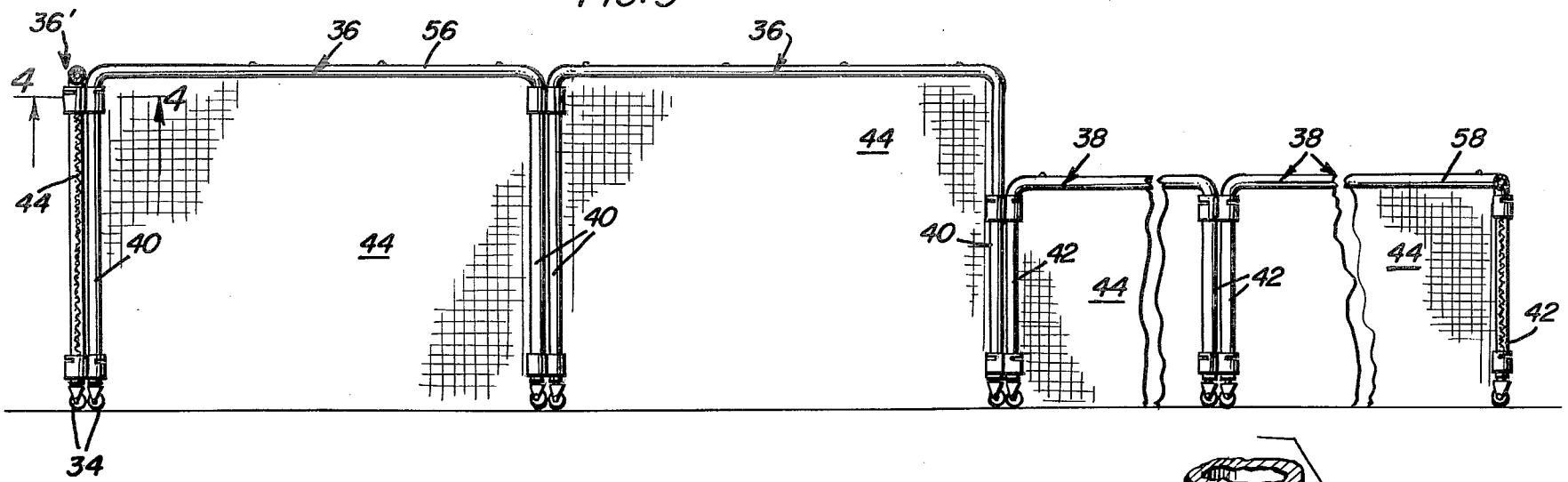
FIG. 3 is an enlarged, fragmentary, sectional view taken taken generally along the line 3—3 of FIG. 1.

As perhaps can best be seen from FIG. 3, each of the sections 20, 20′ is constructed from a generally U-shaped frame 36, 38, respectively, each provided with a pair of substantially parallel, coextensive, downwardly extending legs 40 and 42, with the casters 34 being inserted in the open bottom, socket-forming portions of such legs 40 and 42. Netting 44, which may be of conventional nylon mesh, and the like, is stretched over the frames 36, 38 and secured thereto in a conventional manner so as to restrain tennis balls, and the like, from passing through the sections 20, 20′ partially formed by the frames 36, 38 and associated netting 44. Each of the controlled motion hinge coupler joints 22 employs a body member in the form of a joined pair of coextensive tubes 46 each having a through bore substantially parallel to the bore of the other of the tubes and provided with a pair of diametrically oppositely disposed slots 48 extending longitudinally transversely to the extent of the bores of the tubes 46, and arranged for receiving a respective roll pin 50. Holes 52 are provided through the legs 40, 42 of each of the frames 36, 38 in the upper and lower portions thereof, and each of the legs 40, 42 is inserted into respective ones of the tubes 46 of a coupler joint 22 and a pin 50 inserted through the associated slots 48 and holes 52 to retain the coupler joint 22 in a desired position. It will be appreciated that the leg 40 which is joined to a leg 42 of frame 38 will have the uppermost ones of the holes provided therein at a much lower level toward the supporting surface of the cage 10 than will be the holes 52 provided the legs 40 so as to permit articulation between a frame 38 and a frame 36. The slots 48 bisect a sufficient arc of each of the associated tubes 46 to permit the desired folding and unfolding of the associated sections 20, 20′ and each of these slots 48 should be of sufficient length to permit each of the sections 20, 20′ to move from positions adjacent and substantially parallel to one another to positions either coplanar or perpendicular to one another.

Figure 5:
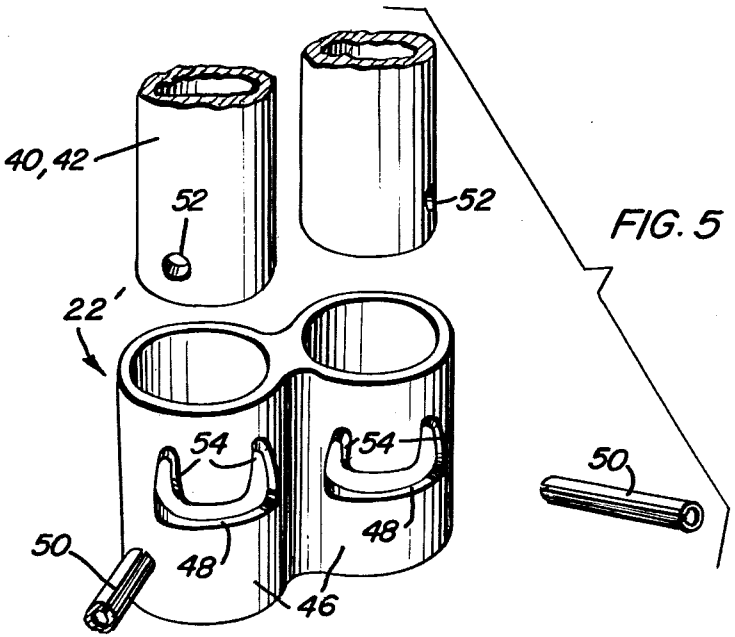
FIG. 5 is a fragmentary, exploded, perspective view showing the details of a preferred mode of a coupler joint used in articulating a serving cage according to the present invention
Figure 4:
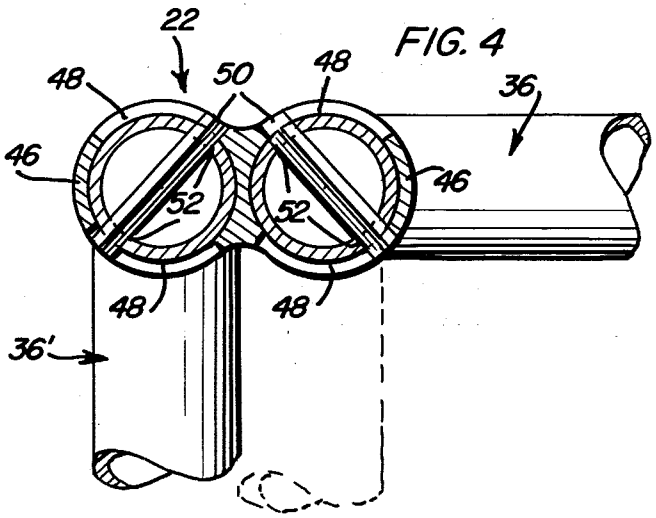
FIG. 4 is an enlarged, fragmentary, sectional view taken generally along the line 4—4 of FIG. 3.

In general, for movement beyond a 60° angle, the slots 48 preferably become an internal groove (not shown) using either an insertion hole for the pin 50, or using a spring loaded telescoping pin, not shown but of generally conventional construction. Further, in order to lock the barrier 18 in either unfolded or folded positions, vertical slots 54 can be provided on at least the uppermost of the coupler joints 22, so as to form a coupler joint 22′ as seen in FIG. 5, and the couplers themselves can slide up and down relative to their associated legs 40, 42 so as to positively lock the adjoining sections 20, 20′ against movement relative to one another.

In addition, although the legs 40 and 42 are shown constructed as a single piece, it is to be understood that these legs could be constructed with reduced diameter fittings connected to the upper rails 56, 58 of frames 36, 38 and lower rails provided, if desired, and the legs being merely straight sections extending between the associated couplers 22 and/or 22′.

As can be readily understood from the above description and from the drawings, a serving cage according to the present invention will stop tennis balls that have been hit into the service area of a tennis court. The taller half 24 of the two halves of barrier 18 will serve to retain balls bouncing off of the surface of the service court area 12, which height is not needed for balls closer to net 16. For example, the height of the sections 20 can be 5′ tall, while the sections 20′ need be only 3′6″ tall. Further, suitable dimensions for the width of the end walls 28, 28′ is 13′6″, while the side walls 30, 30′ and 32, 32′ need been only 6′3″ long to assure easy folding of the various sections relative to one another. When constructed to the aforementioned dimensions, the entire unit will be collapsed for storage to a size of only 5′×13′6″×18″ when folded.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A serving cage placeable on a service court area of a tennis court, for capturing tennis balls served into the service court area, the cage comprising a continuous barrier having a rectangular configuration in plan and conforming dimensionally to the periphery of a standard U.S. Lawn Tennis Association tennis service court.

2. A structure as defined in claim 1, wherein the barrier is collapsible and includes a plurality of fence sections each of planar, rectangular configuration and pivotally connected to a pair of adjacent ones of the sections for permitting the barrier to be folded and unfolded, the barrier being rectangular in plan when in an unfolded mode.

3. A structure is defined in claim 2, wherein the barrier is formed in two halves each substantially the same size as the other in plan and including an equal number of sections, but one of the halves being substantially twice the height from a surface supporting the barrier than the other of the halves of the barrier.

4. A structure as defined in claim 3, wherein each of the halves of the barrier includes five articulated sections forming one end wall of the barrier and four paired side walls, the side walls being substantially one-half the length of the end wall.

5. A structure as defined in claim 3, wherein a plurality of casters are mounted on the sections of the barrier and are disposed engaging the surface supporting the barrier for facilitating movement of the barrier reltive to the supporting surface.

6. A structure as defined in claim 1, wherein a plurality of casters are mounted on the barrier and disposed engaging a surface supporting the barrier for facilitating movement of the barrier relative to the support surface.

7. A structure as defined in claim 1, wherein the barrier is formed in two halves each substantially the same size as the other in plan and including an equal number of sections, but one of the halves being substantially twice the height from a surface supporting the barrier than the other of the halves of the barrier, the other of the halves of the barrier being arrangeable closest to a net of a tennis court.

8. In combination with a standard U.S. Lawn Tennis Association tennis court having a designated service court area, a serving cage for capturing tennis balls served into the service court area, the serving cage comprising a continuous barrier having a rectangular configuration in plan and conforming dimensionally to the periphery of said service court area .

9. A structure as defined in claim 8, wherein the barrier is collapsible and includes a plurality of fence sections each of planar, rectangular configuration and pivotally connected to a pair of adjacent ones of the sections for permitting the barrier to be folded and unfolded, the barrier being rectangular in plan when in an unfolded mode.

10. A structure as defined in claim 9, wherein the barrier is formed in two halves each substantially the same size in plan as the other of the halves of the barrier and including an equal number of sections, but one of the halves being substantially twice the height from the surface of the tennis court than the other of the halves of the barrier, each of the halves of the barrier including five articulated sections forming one end wall and four paired side walls, the side walls being substantially one-half the length of the end wall, and a plurality of casters mounted on the sections of the barrier and disposed engaging the surface of the tennis court for facilitating movement of the barrier relative to the surface of the tennis court.

* * * * *